US006641668B1

(12) United States Patent
Edgerton

(10) Patent No.: US 6,641,668 B1
(45) Date of Patent: Nov. 4, 2003

(54) PAINTING STAND AND METHOD FOR PAINTING

(76) Inventor: Darryl Edgerton, 6216 Beach Bayou Rd., Biloxi, MS (US) 39532

( * ) Notice: Subject to any disclaimer, the term of this patent is extended or adjusted under 35 U.S.C. 154(b) by 0 days.

(21) Appl. No.: 10/136,052

(22) Filed: May 1, 2002

(51) Int. Cl.[7] ..... B05C 13/00

(52) U.S. Cl. ..... 118/500; 118/502; 248/165; 248/166; 269/47; 269/53; 269/905

(58) Field of Search ..... 118/500, 502; 248/165, 166; 269/47, 53, 905

(56) References Cited

U.S. PATENT DOCUMENTS

| | | | | |
|---|---|---|---|---|
| 684,097 | A | | 10/1901 | Quigley |
| 1,106,915 | A | | 8/1914 | Beasejour |
| 1,581,960 | A | | 4/1926 | King |
| 2,599,010 | A | | 6/1952 | Pernitz |
| 2,849,745 | A | | 9/1958 | Madsen |
| 3,006,107 | A | | 10/1961 | Tolegian |
| 3,643,935 | A | | 2/1972 | Bell |
| 3,858,864 | A | | 1/1975 | Waldow |
| 3,861,662 | A | | 1/1975 | Morse |
| 3,923,167 | A | | 12/1975 | Blankenbeckler |
| 4,141,192 | A | | 2/1979 | Augustine |
| 4,278,244 | A | | 7/1981 | Carter |
| 4,577,843 | A | * | 3/1986 | Milwain ..... 269/51 |
| 4,728,065 | A | | 3/1988 | Coote |
| 4,810,151 | A | | 3/1989 | Shern |
| 4,932,391 | A | | 6/1990 | Bierdeman |
| 4,966,549 | A | * | 10/1990 | Ohdate ..... 432/253 |
| 5,090,648 | A | | 2/1992 | Wood, IV |
| D325,505 | S | | 4/1992 | Hernandez |
| 5,164,011 | A | | 11/1992 | Ray |
| 5,294,099 | A | * | 3/1994 | Dalfino ..... 269/133 |
| 5,509,544 | A | | 4/1996 | Osborn |
| 5,551,980 | A | | 9/1996 | Turnbo |
| 5,846,016 | A | | 12/1998 | Martinez et al. |
| 5,894,945 | A | | 4/1999 | Curran |
| 6,090,204 | A | | 7/2000 | Speed et al. |
| 6,338,758 | B1 | | 1/2002 | Curran |

* cited by examiner

*Primary Examiner*—Laura Edwards
(74) *Attorney, Agent, or Firm*—Garvey, Smith, Nehrbass & Doody, LLC; Brett A. North

(57) ABSTRACT

A method and apparatus for holding an article to be painted coated with a stand. In one embodiment the stand comprises (a) a first leg, (b) a second leg, (c) an upper connecting member attached to the first and second legs at an upper elevational position, (d) a base connecting the first and second legs at a lower elevational position, (e) at least part of the upper connecting member being insertable in a hardware opening of the article, and (f) the base extending on at least two sides of the article.

34 Claims, 4 Drawing Sheets

PAINTING STAND AND METHOD FOR PAINTING

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND

1. Field

The invention relates to a stand assembly for holding an object to be painted/coated, such as a door, window frame, or the like and a method for painting/coating same. More particularly, the present invention relates to a stand which can be used to quickly and efficiently stand an object to be painted/coated, such as a door, window frame, or the like.

2. General Background

During the building, repair or renovation of a house, office building, or the like, doors, windows, and the like, often times must be painted/coated on site. If they are first "hung" in place, and thereafter painted/coated, many situations will cause the painting/coating process to be delayed because of inaccessibility of one or more surface areas of the door or window. Additionally, the permanent affixation of the door prior to painting/coating often requires painting/coating of just one side of the door prior to movement thereof before complete drying occurs. Therefore, there is a need of a device facilitating support of a door, window, or similar object for painting/coating purposes prior to permanent affixation in the building for convenience and which permits all surfaces of the object to be painted/coated during one continuous procedure.

For a standard three bedroom home, at least eleven doors would require painting/coating. At least two coats of paint are typically applied to each door with a minimum of thirty minutes drying time between coats. These doors typically must be painted/coated simultaneously, otherwise, the job would be unduly extended. Furthermore, craftsmen such as plumbers, carpenters, and cabinet fabricators, may also be performing work on the home and require access to various areas where the doors being painted/coated are stored. Accordingly, the doors may require relocation during the painting/coating job.

A typical method for painting multiple doors currently requires a strip of wood with nails about every 2 to 3 feet on top of the door centers. For stability these doors must be staggered angularly and at least 3 to 4 doors must be connected together at one time. This method requires at least two individuals for setting up the doors.

Patents on devices for assisting the holding of items to be painted or coated are listed below:

| U.S. Pat. No. : | PATENTEE: |
|---|---|
| 684,097 | Quigley et al |
| 1,106,915 | Beasejour |
| 1,581,960 | King |
| 2,599,010 | Pernitz |
| 5,090,648 | Wood |
| 5,164,011 | Ray |
| 5,846,016 | Martinez et al. |
| 5,894,945 | Curran |
| 6,090,204 | Speed et al. |
| 6,338,758 | Curran |

All of these prior art devices are deficient in one way or another such as failing to allow quick set up and break down by a single individual of one or more items to be painted or coated.

Further, excepting Martinez et al., none of the devices are portable allowing storage of multiple stands in a small area. Martinez et al. requires that at least two items to be painted or coated be affixed to each other using fasteners in screw holes requiring the time to so affix the fasteners and risking possible cross-threading of the screw holes.

The present invention addresses the deficiencies of the prior art as described above and therein.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a method and apparatus for painting or coating items.

It is an object of the method and apparatus of the present invention to allow a single man to set up and paint or coat all articles in a particular job. Furthermore, a single man should be able to relocate any of the articles being painted/coated without dismantling the apparatus of the invention.

It is another object of the method and apparatus of the present invention to allow several items to be painted/coated in a relatively small area.

In one embodiment no assembly is required to set up the article to be painted or coated.

In one embodiment, after hardware has been removed, a single man using the method and apparatus of the present invention can set up to eight doors for painting in about one minute.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 4:
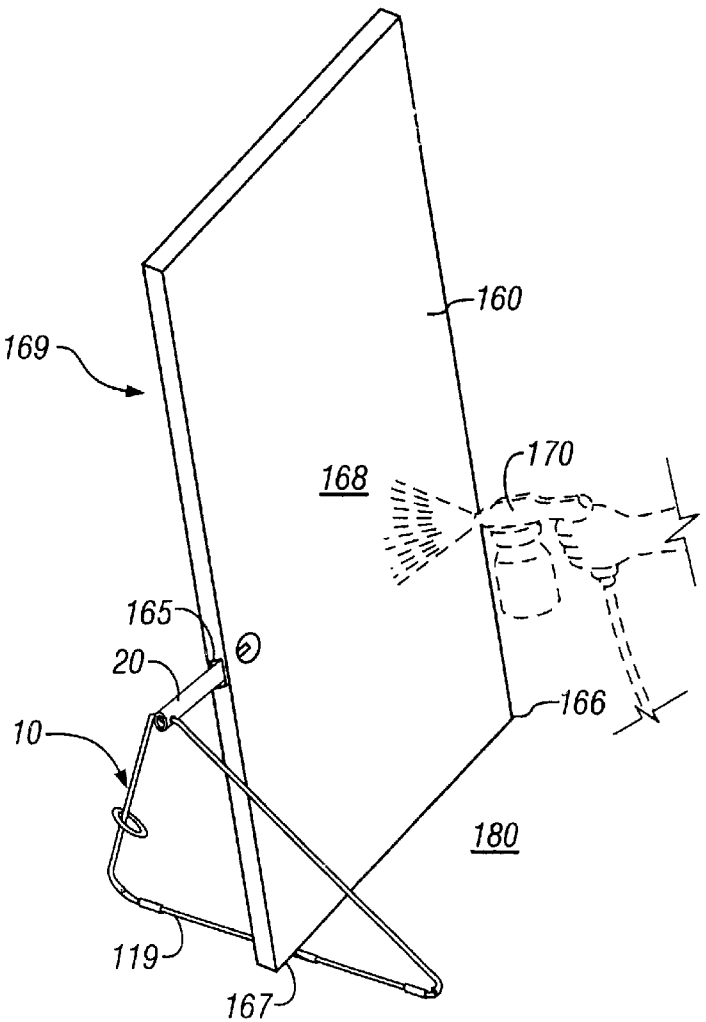
FIG. 4 shows a perspective view of one embodiment of the method and apparatus of the present invention being used to paint a door.

FIG. 4 shows door stand 10 holding up door 160 for painting by spray gun 170. Upper connecting member 20 is placed inside hardware opening 165. Bottom of door 167 contacts base 119 and base 119 contacts ground surface 180. Bottom edge of door 166 also contacts ground surface 180. Base 119 will resist tipping of door 160 in either direction of first and second door surfaces 168,169. The bottom of door 160 will resist tipping of door 160 in a direction transverse to first and second door surfaces 168,169. If door 160 is tipped slightly it will tend to return to the vertical position. Accordingly, door 160 will be held stable while being painted. The article(s) to be painted or coated can be set up anywhere a relatively flat surface can be found.

Figure 1:
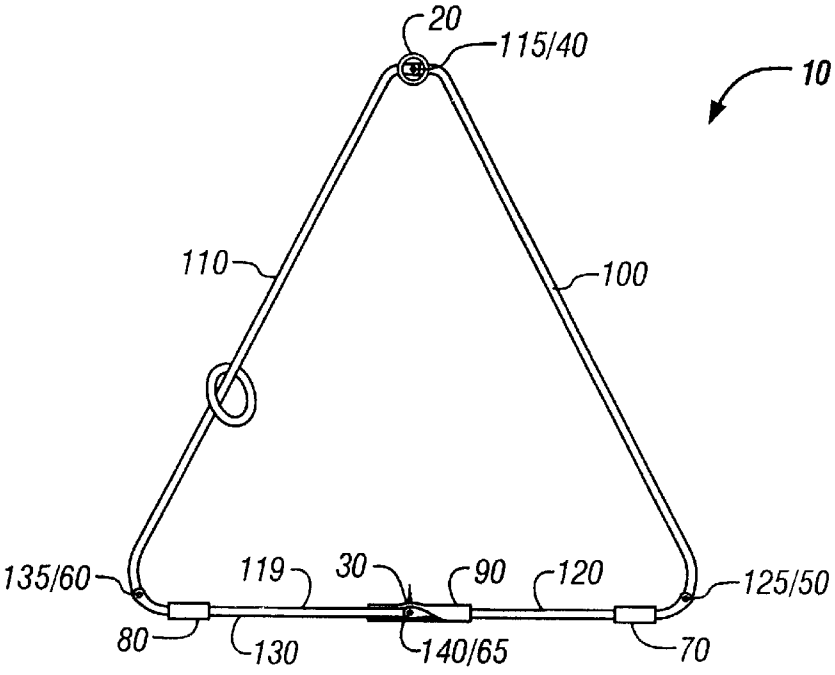
FIG. 1 is a preferred embodiment of the apparatus of the present invention wherein the apparatus is collapsible.

FIG. 1 is a preferred embodiment of door stand 10 wherein stand 10 is collapsible. Stand 10 is comprised of first leg 100, second leg 110, and base 119. Base 119 is comprised of first base portion 120 and second base portion 130. Upper connecting member 20 is attached to the connection 115 between first leg 100 and second leg 110.

Upper connecting member 20 is preferably constructed of a flexible material such as an elastomer or rubber. Flexibility allows for differential movement between stand 10 and door 160. However, upper connecting member 20 can be constructed of any material of suitable strength such as polymer, plastics, metal, wood, glass, ceramic, or other material.

Pin 30 is attached to pivot stop/catch 90 and helps ensure contact between base 119 and bottom of door 167 (FIG. 4). Pin 30 can be a metal, wood, elastomer, rubber, polymer, plastic, glass, or other suitable material which can facilitate engagement, frictional or otherwise, between base 119 and bottom of door 167. Pin 30 can also be a ridge or bumper (not shown) facilitating frictional engagement between base 119 and bottom of door 167.

First boot 70 and second boot 80 are attached to base 119. Boots 70, 80 are preferably constructed of a material with adequate wear resistance and facilitates frictional engagement with ground 180. Boots 70,80 can be constructed of an elastomer, rubber, polymer, plastic, metal, wood, or other suitable material.

Figure 2:
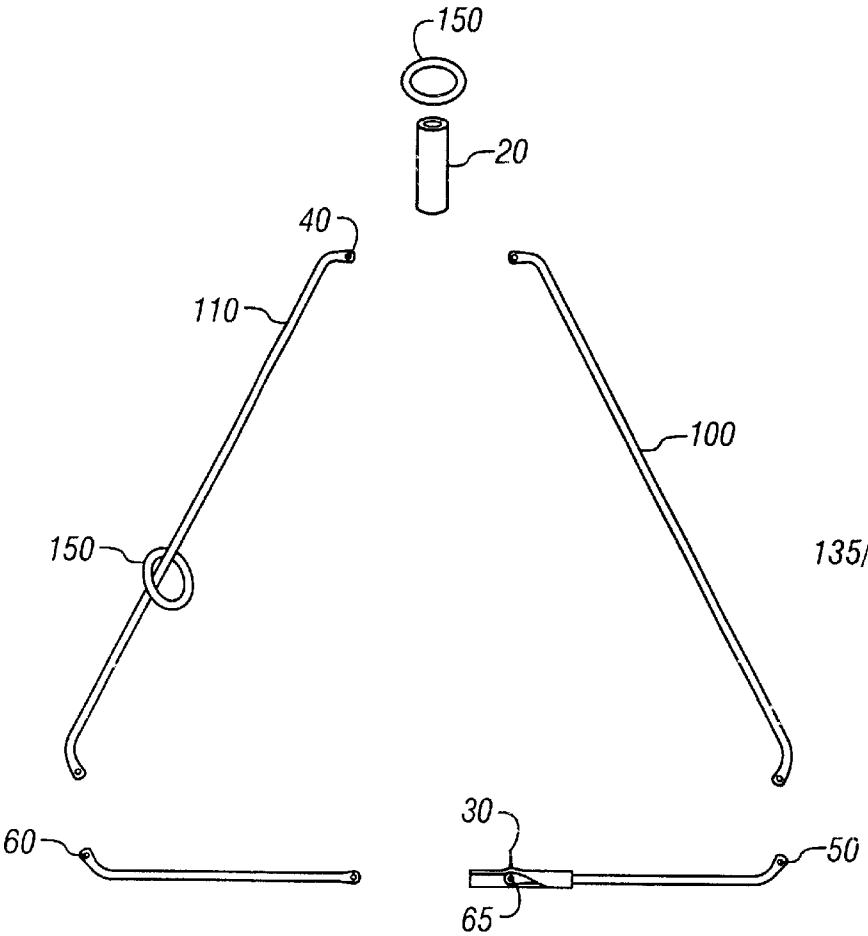
FIG. 2 is an exploded view of the embodiment shown in FIG. 1.
Figure 3:
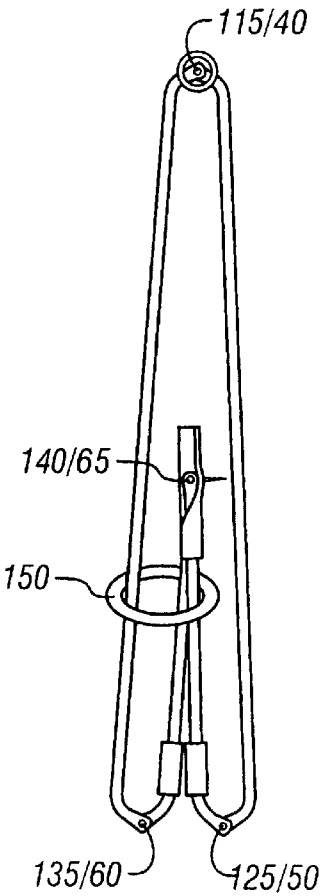
FIG. 3 shows the embodiment shown in FIG. 1 but in a collapsed position.

First pivot 40, second pivot 50, third pivot 60, and fourth pivot 65 facilitate the collapsing of stand 10 (FIGS. 2 and 3). First pivot 40 pivotally connects first leg 100 and second leg 110. Second pivot 50 pivotally connects first leg 100 and first base portion 120. Third pivot 60 pivotally connects second base portion 130 and second leg 110. Fourth pivot pivotally connects first base portion 120 and second base portion 130.

FIG. 1 shows stand 10 in an open condition and ready to be used to support door 160. When in the open position fourth pivot stop/catch 90 resists further pivoting of first and second base portions 120,130. FIG. 2 shows an exploded view of collapsible stand 10. FIG. 3 shows stand 10 in a collapsed condition ready to be stored. Ring 150 can be used to maintain stand 10 in the collapsed condition and ready for storage Stand 10 is preferably sized to fit a standard door. Suitable dimensions for stand 10 can nominally be about 40 inches for first and second legs 100, 110 and about 34 inches for base 119. Those of ordinary skill in the art can size stand 10 for various articles to be painted or coated.

In an alternative embodiment not shown, stand 10 can be non-collapsible. In such non-collapsible embodiment first and second legs 100,110 and base 119 would not be pivotally connected but affixed to one another. Such an embodiment, although not collapsible, would have less moving parts and theoretically a longer useful life.

Figure 5:
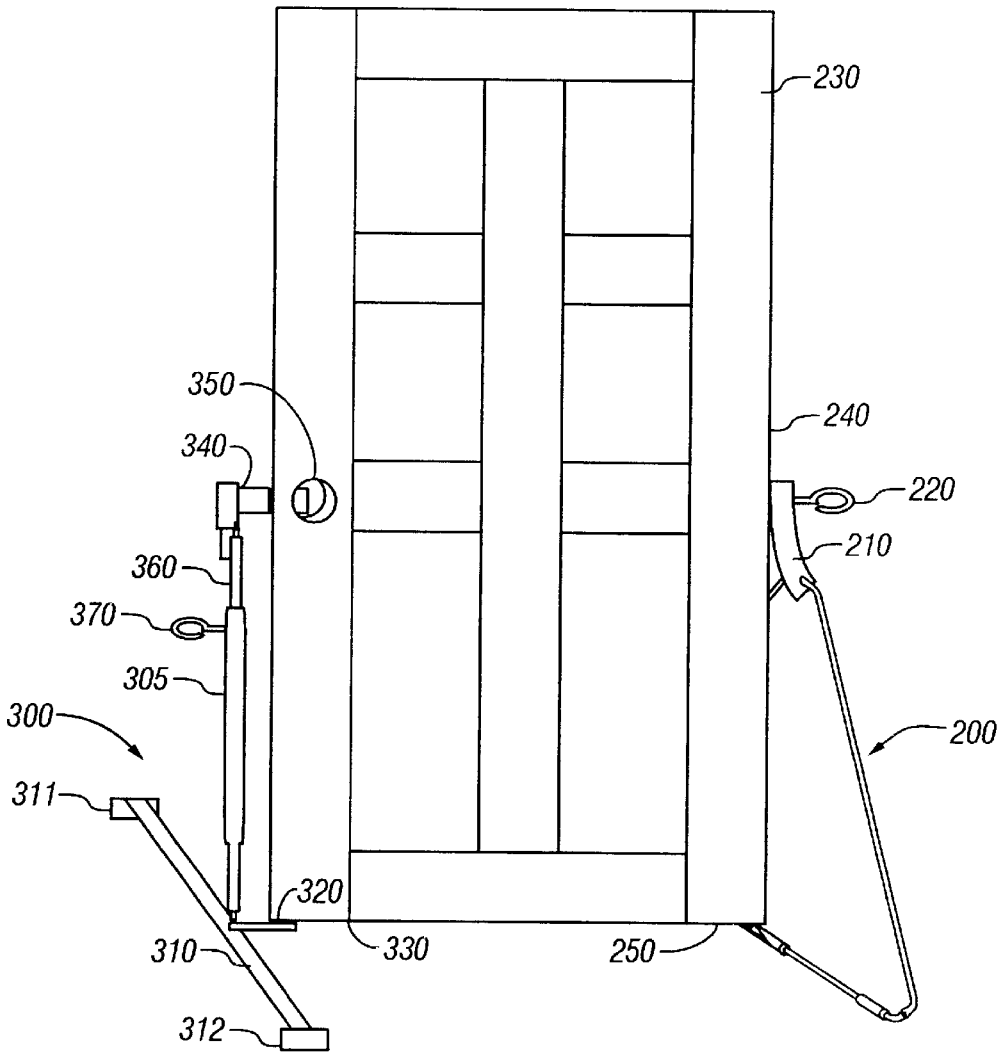
FIG. 5 shows two additional alternative embodiments of the method and apparatus of the present invention which can be used to support a door to be painted.

FIG. 5 shows two alternative embodiments: (a) tacked embodiment 200 and (b) T-embodiment 300. Construction of the tacked embodiment 200 can be similar to the embodiment disclosed in FIG. 1–3. However, pin 220 can be added to upper connecting member 210. Pin 220 connects to side of door 240. Pin 220 can be any fastener such as a pin, nail, screw, staple, magnet, or adhesive. Engagement between tacked embodiment 200 and door 230 occurs at bottom of door 250. Connection between pin 220 and side of door 240 is not limited to hardware opening 350, but can be at other locations along the side of door.

T-embodiment 300 can include base 310, pin 320, lower arm 305, and upper connecting member 340. For adjustability upper arm 360 and adjusting screw 370 can be provided. Upper arm 360 can telescopically fit within lower arm 305 allowing for adjusting the height of upper connecting member 340 to be inserted in hardware opening 350. Base 310 can include base ends 311, 312. Pin 320 can be connected to base 310 and engages bottom of door 330.

Figure 6:
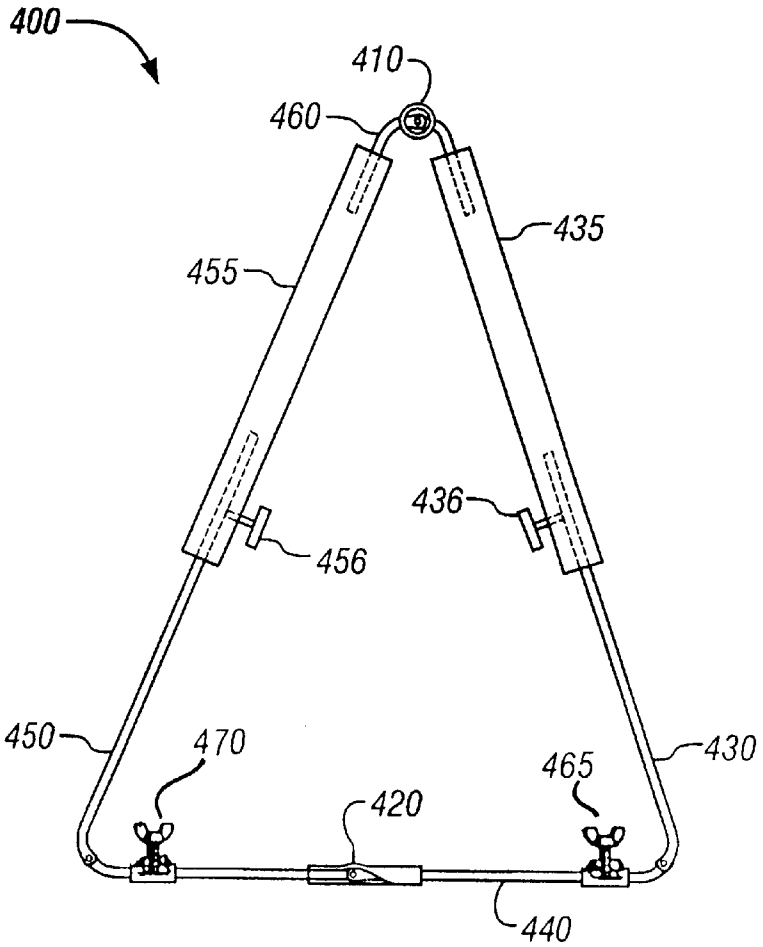
FIG. 6 shows another alternative embodiment of the apparatus of the present invention allowing for adjustment and in an extended orientation.
Figure 7:
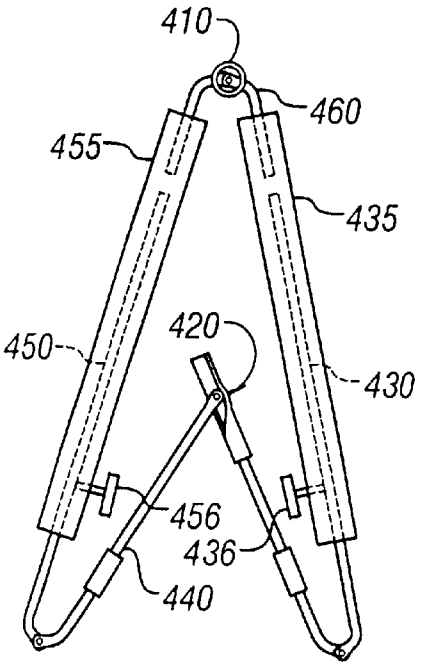
FIG. 7 shows the embodiment of FIG. 6 in a contracted and collapsed orientation.

FIGS. 6 and 7 show an alternative adjustable embodiment 400. The extended orientation is shown in FIG. 6 and contracted orientation in FIG. 7. FIG. 7 also shows the stand 400 in a collapsed orientation. First and second sleeves 435,455 can connect first and second legs 430,450 with top portion 460. Adjusting screws 436, 456 can be used to lock first and second sleeves 435,455 with first and second legs 430,450 when the desired extended position is achieved. Pin 420 can be located on base 440 and upper connecting member 410 located on top portion 460.

FIG. 6 also shows another alternative embodiment utilizing adjusting screws 465,470. Adjusting screws 465,470 can be threadably connected to base 440 allowing their adjustment for protrusion through bottom of base 440. Adjusting screws 465,470 help bring bottom of door 167 (FIG. 4) to a higher position and leveling door 160 allowing re-attachment of hinges to door 160. Such adjustment feature facilitates setting door 160 back on its hinges after door 160 has been painted or coated thereby allowing a single man to easily set door 160. Adjusting screws 465,470 can be added to any one of the embodiments disclosed in FIGS. 1 through 7. Adjusting screws 465,470 can also be located at different positions on any of the embodiments disclosed in FIGS. 1 through 7, such as at the comers. Adjusting screws 465,470 can also be removably attached to any of the embodiments disclosed in FIGS. 1 through 7, such as by clips or other attachment means.

In various embodiments shown in FIGS. 1–7 a triangular shape for stand 10 has been shown. However, those skilled in the art will realize that other shapes can be used such as a rectangle, parallelogram, parabola, semicircle, T, Y, along with other configurations. The design takes into account the requirement of having at least one upper connecting point on the side of the article to be held, at least one lower connecting point on the bottom of the door, and at least two ground contacts point on opposite sides of the article.

The following is a list of reference numerals:

LIST FOR REFERENCE NUMERALS

| (Ref. No.) | (Description) |
|---|---|
| 10 | door stand |
| 20 | upper connecting member |
| 30 | pin |
| 40 | first pivot |
| 50 | second pivot |
| 60 | third pivot |
| 65 | fourth pivot |
| 70 | first boot |
| 80 | second boot |
| 90 | fourth pivot stop/catch |
| 100 | first leg |
| 110 | second leg |
| 115 | connection between first leg and second leg |
| 119 | base |
| 120 | first base portion |
| 125 | connection between first leg and first base portion |
| 130 | second base portion |
| 135 | connection between second leg and second base portion |
| 140 | connection between first base portion and second base portion |
| 150 | ring |
| 160 | door |
| 165 | hardware opening |
| 166 | bottom edge of door |
| 167 | bottom of door |
| 168 | first surface of door |
| 169 | second surface of door |
| 170 | spray gun |
| 180 | ground surface |
| 200 | tacked embodiment |
| 210 | upper connecting member |
| 220 | pin |
| 230 | door |
| 240 | side of door |
| 250 | bottom of door |
| 300 | T-embodiment |
| 305 | lower arm |
| 310 | base |
| 311 | base end |
| 312 | base end |
| 320 | pin |
| 330 | bottom of door |
| 340 | upper connecting member |
| 350 | hardware opening |
| 360 | upper arm |
| 370 | adjusting screw |
| 400 | adjustable embodiment |
| 410 | upper connecting member |
| 420 | pin |
| 430 | first leg |

-continued

LIST FOR REFERENCE NUMERALS

| (Ref. No.) | (Description) |
|---|---|
| 435 | first sleeve |
| 436 | adjusting screw |
| 440 | base |
| 450 | second leg |
| 455 | second sleeve |
| 456 | adjusting screw |
| 460 | top portion |
| 465 | adjusting screw |
| 470 | adjusting screw |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods and apparatuses differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A stand for holding an article to be painted or coated comprising:

(a) a first leg, (b) a second leg, (c) an upper connecting member attached to the first and second legs at an upper elevational position, (d) a base connecting the first and second legs at a lower elevational position, (e) at least part of the upper connecting member being insertable in an opening of the article, (f) the base extending on at least two sides of the article, and (g) an engaging member located on the base for engaging the bottom of the article.

2. The stand in claim 1, wherein the engaging member is a pin.

3. The stand in claim 1, wherein the engaging member is a rubber block.

4. The stand in claim 1, wherein the engaging member is a raised ridge.

5. The stand in claim 1, wherein the upper connecting member is at least partially constructed of a flexible material.

6. The stand in claim 5, wherein the flexible material is rubber.

7. The stand in claim 1, further comprising a pin which can fasten the upper connecting member to a side of the article.

8. The stand in claim 1, further comprising a pair of adjusting screws connected to the base.

9. A stand for holding an article to be painted or coated comprising:

(a) a first leg, (b) a second leg, (c) an upper connecting member attached to the first and second legs at an upper elevational position, (d) a base connecting the first and second legs at a lower elevational position, (e) at least part of the upper connecting member being insertable in an opening of the article, (f) the base extending on at least two sides of the article, and (g) wherein the first and second legs can be telescopically extended.

10. The stand in claim 9, further comprising first and second adjusting screws respectively maintaining the telescopic extension of the first and second legs.

11. A stand for holding an article to be painted or coated comprising:

(a) a first leg, (b) a second leg, (c) an upper connecting member attached to the first and second legs at an upper elevational position, (d) a base connecting the first and second legs at a lower elevational position, (e) at least part of the upper connecting member being insertable in an opening of the article, (f) the base extending on at least two sides of the article, and (g) wherein the first and second legs are pivotally connected to the upper connecting member, the first and second legs are pivotally connected to the base and the base comprises first and second base portions which are pivotally connected to each other, these pivoting connections allowing the stand to be switched from an open orientation to a collapsed orientation.

12. The stand in claim 11, further comprising a pivot catch located at the pivot connection between the first and second base portions, the pivot catch restricting the rotational freedom of the first and second base portions.

13. The stand in claim 11, further comprising a ring connected to the first leg, the ring encircling the first leg and the first and second base portions when the stand is in a collapsed orientation.

14. A stand for holding an article to be painted or coated comprising:

(a) a leg, (b) an upper connecting member attached to the leg at an upper elevational position, (c) a base attached to the leg at a lower elevational position, (d) at least part of the upper connecting member being insertable in an opening of the article, (f) the base extending on at least two sides of the article, and (g) an engaging member located on the base for engaging the bottom of the article.

15. The stand in claim 14, wherein the engaging member is a pin.

16. The stand in claim 14, wherein the engaging member is a rubber block.

17. The stand in claim 14, wherein the engaging member is a raised bridge.

18. The stand in claim 14, wherein the upper connecting member is at least partially constructed of a flexible material.

19. The stand in claim 18, wherein the flexible material is rubber.

20. The stand in claim 14, wherein the leg can be telescopically extended.

21. The stand in claim 20, further comprising an adjusting screw maintaining the telescopic extension of the leg.

22. The stand in claim 14, further comprising a pair of adjusting screws connected to the base.

23. A method of holding an article to be painted or coated comprising:

(a) positioning an article to be painted in a substantially vertical position, (b) holding the article with a stand in the substantially vertical position, the stand comprising:

(i) a first leg, (ii) a second leg, (iii) an upper connecting member attached to the first and second legs at an upper elevational position, (iv) a base connecting the first and second legs at a lower elevational position, (v) at least part of the upper connecting member being insertable in an opening of the article, (vi) the base extending on at least two sides of the article, and (vii) an engaging member located on the base for engaging the bottom of the article.

24. The method of claim 23, wherein the engaging member is a pin.

25. The method of claim 23, wherein the engaging member is a rubber block.

26. The method of claim 23, wherein the engaging member is a raised ridge.

27. The method of claim 23, wherein the upper connecting member is at least partially constructed of a flexible material.

28. The method of claim 21, wherein the flexible material is rubber.

29. The method of claim 23, further comprising a pin which can fasten the upper connecting member to a side of the article.

30. A method of holding an article to be painted or coated comprising:

(a) positioning an article to be painted in a substantially vertical position, (b) holding the article with a stand in the substantially vertical position, the stand comprising:

(i) a first leg, (ii) a second leg, (iii) an upper connecting member attached to the first and second legs at an upper elevational position, (iv) a base connecting the first and second legs at a lower elevational position, (v) at least part of the upper connecting member being insertable in an opening of the article, (vi) the base extending on at least two sides of the article, and (vii) wherein the first and second legs can be telescopically extended.

31. The method of claim 30, further comprising first and second adjusting screws respectively maintaining the telescopic extension of the first and second legs.

32. A method of holding an article to be painted or coated comprising:

(a) positioning an article to be painted in a substantially vertical position, (b) holding the article with a stand in the substantially vertical position, the stand comprising:

(i) a first leg, (ii) a second leg, (iii) an upper connecting member attached to the first and second legs at an upper elevational position, (iv) a base connecting the first and second legs at a lower elevational position, (v) at least part of the upper connecting member being insertable in an opening of the article, (vi) the base extending on at least two sides of the article, and (vii) the first and second legs are pivotally connected to the upper connecting member, the first and second legs are pivotally connected to the base and the base comprises first and second base portions which are pivotally connected to each other, these pivoting connections allowing the stand to be switched from an open orientation to a collapsed orientation.

33. The method of claim 32, further comprising a pivot catch located at the pivot connection between the first and second base portions, the pivot catch restricting the rotational freedom of the first and second base portions.

34. The method of claim 32, further comprising a ring connected to the first leg, the ring encircling the first leg and the first and second base portions when the stand is in a collapsed orientation.

* * * * *